US007204220B2

(12) United States Patent
Schmidt et al.

(10) Patent No.: US 7,204,220 B2
(45) Date of Patent: Apr. 17, 2007

(54) DEVICE FOR IGNITING AN AIR-FUEL MIXTURE IN AN INTERNAL COMBUSTION ENGINE BY MEANS OF A HIGH FREQUENCY ELECTRIC ENERGY SOURCE

(75) Inventors: Ewald Schmidt, Ludwigsburg (DE); Michael Thiel, Leonberg (DE); Juergen Hasch, Stuttgart (DE); Hans-Oliver Ruoss, Stuttgart (DE); Klaus Linkenheil, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/521,683

(22) PCT Filed: Aug. 25, 2003

(86) PCT No.: PCT/DE03/02828

§ 371 (c)(1),
(2), (4) Date: Jul. 28, 2005

(87) PCT Pub. No.: WO2004/020820

PCT Pub. Date: Mar. 11, 2004

(65) Prior Publication Data

US 2006/0048732 A1 Mar. 9, 2006

(30) Foreign Application Priority Data

Aug. 28, 2002 (DE) ..... 102 39 410

(51) Int. Cl.
*F02P 23/04* (2006.01)

(52) U.S. Cl. ..... 123/143 B

(58) Field of Classification Search ..... 123/598, 123/599, 601, 605–606, 608, 143 B, 634; 333/246–248, 99 PL See application file for complete search history.

(56) References Cited

U.S. PATENT DOCUMENTS 4,677,960 A * 7/1987 Ward ..... 123/598

(Continued)

FOREIGN PATENT DOCUMENTS

DE 197 47 701 5/1999

(Continued)

OTHER PUBLICATIONS

R. Stiles, "Investigation of a Radio Frequency Plasma Ignitor for Possible Internal Combustion Engine Use,", SAE-Paper 970071, Society of Automotive Engineers, Warrendale, PA, US, XP008026009.

*Primary Examiner*—Hai Huynh
(74) *Attorney, Agent, or Firm*—Kenyon & Kenyon LLP

(57) ABSTRACT

A device is described for igniting an air-fuel mixture in an internal combustion engine using a high-frequency electric power source having a coaxial waveguide structure (5) into which the high-frequency electric power may be coupled and whose one end protrudes into the individual combustion chamber of a cylinder of the internal combustion engine. The one end of the coaxial waveguide structure (5) is designed as an igniter (7*a*) in such a way that, when a voltage potential is applied, a field structure (22), protruding into the combustion chamber, and thus a free-standing plasma in the air-fuel mixture at the inner conductor (7, 7*a*), projecting from the waveguide structure, is generatable via an abrupt and/or smooth cross-section change (21) of the inner conductor (7) and/or the outer conductor (6).

9 Claims, 1 Drawing Sheet

U.S. PATENT DOCUMENTS

Figure 1:
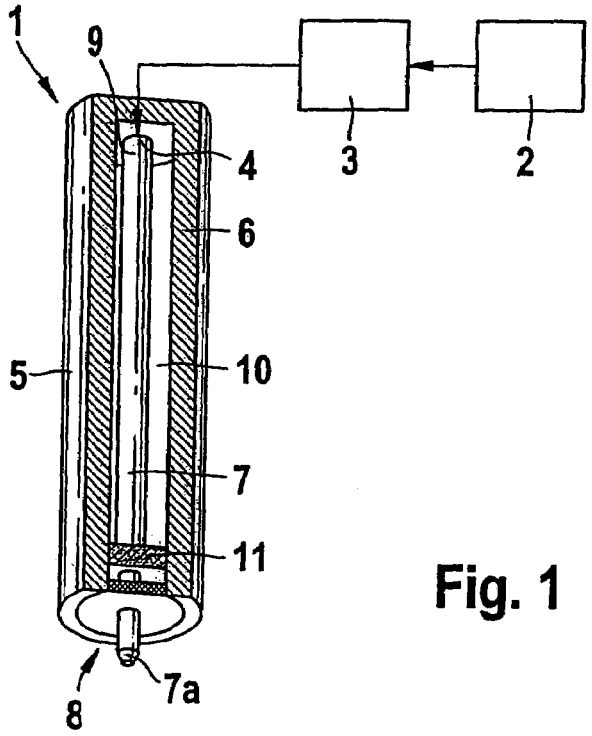

| | | | | | |
|---|---|---|---|---|---|
| 4,766,855 | A | * | 8/1988 | Tozzi | 123/143 B |
| 5,076,223 | A | * | 12/1991 | Harden et al. | 123/143 B |
| 5,211,142 | A | * | 5/1993 | Matthews et al. | 123/143 B |
| 5,361,737 | A | | 11/1994 | Smith et al. | 123/143 B |
| 5,649,507 | A | * | 7/1997 | Gregoire et al. | 123/143 B |
| 5,983,871 | A | * | 11/1999 | Gordon et al. | 123/536 |
| 6,357,426 | B1 | * | 3/2002 | Schleupen | 123/606 |
| 6,883,507 | B2 | * | 4/2005 | Freen | 123/606 |
| 6,918,366 | B2 | * | 7/2005 | Schmidt et al. | 123/143 B |

FOREIGN PATENT DOCUMENTS

| | | | |
|---|---|---|---|
| DE | 198 52 652 | | 5/2000 |
| DE | 10 2004 018 201 | * | 11/2005 |
| EP | 1 544 457 | * | 6/2005 |
| JP | 57 186067 | | 11/1982 |
| JP | 8-195295 | * | 7/1996 |
| JP | 2005-183396 | * | 7/2005 |

* cited by examiner

DEVICE FOR IGNITING AN AIR-FUEL MIXTURE IN AN INTERNAL COMBUSTION ENGINE BY MEANS OF A HIGH FREQUENCY ELECTRIC ENERGY SOURCE

BACKGROUND INFORMATION

The present invention relates to a device for igniting an air-fuel mixture in an internal combustion engine using a high-frequency power source according to the definition of the species in the main claim.

Igniting such an air-fuel mixture using a so-called spark plug is customary in internal combustion engines for motor vehicles. In these ignition systems used today, the spark plug is inductively supplied with an adequately high voltage via an ignition coil so that an ignition spark is generated at the end of the spark plug inside the combustion chamber of the IC engine, triggering the combustion of the air-fuel mixture.

Voltages of more than thirty kilovolt may occur during operation of these conventional spark plugs, the combustion process producing residues, such as soot, oil, or carbon as well as ash from fuel and oil, which are electrically conductive under certain thermal conditions. However, at these high voltages, breakdowns must not occur at the spark plug insulator, so that the electrical resistance of the insulator should not change during the service life of the spark plug, even at the high temperatures occurring.

An ignition device in which the ignition of such an air-fuel mixture in an IC engine of a motor vehicle is performed using a coaxial line resonator is known from DE 198 52 652 A1 for example. The ignition coil is replaced here by a sufficiently powerful microwave source, a combination of a high-frequency generator and an amplifier, for example. In a geometrically optimized coaxial line resonator, the field intensity required for the ignition comes about at the open end of the plug-like line resonator and the voltage sparkover generates an ignitable plasma link between the electrodes of the plug.

Such a high-frequency ignition is also described in the article entitled "Investigation of a Radio Frequency Plasma Ignitor for Possible Internal Combustion Engine Use" published in "SAE-Paper 970071." In this high-frequency ignition or microwave ignition, too, high voltage is generated via a low-resistance supply at the so-called hot end of a $\lambda/4$ line of an HF line resonator, without the ususal ignition coil.

ADVANTAGES OF THE INVENTION

The present invention is directed to a device for igniting an air-fuel mixture in an IC engine using a high-frequency electrical power source, having a coaxial waveguide structure into which the high-frequency electrical power may be coupled and which protrudes with one end into the combustion chamber of a cylinder of an IC engine, a microwave plasma being producible at this end due to a high voltage potential. According to the present invention, the one end of the coaxial waveguide structure is advantageously designed in such a way that, with a voltage potential present, a free-standing plasma is producible in the air-fuel mixture via a field structure protruding into the combustion chamber between the inner conductor, projecting from the waveguide structure by a predefined amount, and the outer conductor of the waveguide structure. In this free-standing plasma cloud around the end of the projecting inner conductor, no sparkover takes place between the electrodes, so that there is also no ionic current flow.

The coaxial waveguide structure is designed in such a way that, for a predefined effective wavelength $\lambda_{eff}$ of the incoupled high-frequency oscillation, a line resonator is obtained approximately according to the formula $(2n+1)*\lambda_{eff}/4$ with $n \geqq 0$ and the high-frequency oscillation is coupled in, for example, via capacitive-, inductive-, mixed-, or aperture coupling. The effective wavelength $\lambda_{eff}$ is essentially determined by the shaping of the end of the projecting inner conductor, by the seal of the dielectric, or by the shaping of the entire line resonator.

In the embodiment according to the present invention, the field intensity required for the ignition in the combustion chamber comes about at the open end of the resonator whose shape is largely similar to that of a spark plug. The essential advantages of such a high-frequency spark plug over the conventional use of a spark plug are most notably cost savings and weight savings due to the possibility of miniaturization. Furthermore, the heat value freedom, achieved to a large extent by the proposed device, allows a reduction in the type variety and thus cost savings as well.

The fact that an electrical measuring signal or control signal, which is a function of the physical variables of the free-standing plasma in the air-fuel mixture, may be decoupled in a simple manner preferably in the oscillator, but possibly also in other areas of the coaxial waveguide, permits adjustability of the spark size in principle, whereby, compared to the conventional spark plug, an enlarged ignition volume and easy introduction of the spark front into the combustion chamber are achievable. This results in an increase in ignition reliability, in particular in lean mix engines and in a gasoline direct injection.

Moreover, due to the possible derivation of control signals which may be decoupled, additional degrees of freedom are gained via the controllability of the spark duration. The decoupled electrical signal may be further processed in an analyzing circuit by which a system diagnosis, regulation of the high-frequency power source, and/or control of predefined operating functions, for example, may be triggered. This controllability based on the possibility of combustion diagnostics and thus optimization of the engine control results in less wear on the structures acting as ignition electrodes and controlled burning off of contaminants, soot for example, is also possible.

If the coaxial resonator is implemented as a cylinder having a constant, circular cross section over its length, then, due to conventional sealing of the resonator's open end, or the separation of the resonator's volume from the combustion chamber, a distinct field distortion or field weakening results at one end at the tip of the inner conductor as a function of the material and the geometric design, in particular the thickness of the seal, and an increase in the power demand for reaching the necessary ignition field strength.

According to the present invention, compared to a resonator having a constant, circular cross section over its length, the power demand is distinctly reduced in an advantageous manner via suitable variation of the cross section of the coaxial resonator, i.e., possibly even below the level of a resonator without a seal.

One end of the coaxial waveguide structure in the combustion chamber is preferably provided with a seal made of dielectric material between the outer conductor and the coaxial inner conductor, the seal being provided with at least one abrupt and/or smooth cross-section change in the axial direction, resulting in an optimal field structure which enables the formation of the free-standing plasma as recited in the main claim. The plasma is formed as a free-standing cloud only at one electrode, i.e., at the end of the projecting inner conductor, and, as mentioned before, no disadvantageous spark gap is formed between two electrodes.

In particular, the seal may advantageously be placed in a recess of the outer conductor which has an abrupt cross-section enlargement toward one end. In addition, in the area of the one end, the cross sections of the inner contour of the outer conductor and the cross section of the outer contour of the inner conductor may be modified accordingly in predefined areas.

The essential advantages of this system according to the present invention are optimal separation of the resonator's volume from the combustion chamber, optionally with simultaneous sealing effect, and reduction of the high-frequency power necessary for the ignition. The concept according to the present invention is advantageously suited for retrofitting into already existing internal combustion engines.

It is possible according to a particularly advantageous embodiment that a compact ignition unit may be formed in that a free-running oscillator circuit and the coaxial waveguide are situated in a common housing; an amplifying circuit may also be placed downstream from the free-running oscillator circuit. The free-running oscillator circuit and/or the downstream amplifying circuit are/is preferably designed as an integrated semiconductor circuit using SiC of GaN components.

The essential advantage of such a compact design of a high-frequency ignition unit is in particular the possibility of size reduction, e.g., from an M14 thread size to an M10 thread size, thus achieving savings in costs and weight since the actual plug and the ignition coil are omitted. Due to physical reasons, conventional spark plugs cannot be minimized to the extent that permits novel, compact ignition systems and valve systems to be implemented in an internal combustion engine, in particular a high-compression engine. Better EMC (electromagnetic compatibility) when these components are integrated into the coaxial geometry of the device is also achievable.

The ignition point and the spark duration may be variably set in a simple manner, in particular in combination with the above-mentioned controllability of the ignition behavior by processing a signal which may be decoupled. As mentioned above, the free-standing plasma may be positively influenced, in particular by controlling the flame size, thereby achieving increased ignition reliability in lean mixes and in gasoline direct injections.

In the design of oscillator circuits for the applications described, it must be taken into account that these are designed not only for one single operating state, because at least two basic operating states may occur, namely the ignited and the unignited state. Furthermore, the transition area between these states and additional influencing parameters, such as temperature, soot build-up, as well as other operating parameters, may have a lasting effect on the resonance behavior and the impedance behavior of the HF resonator. In conventional designs, this frequently results in only a fraction of the available power being coupled into the resonator. The remaining portion is reflected and possibly stresses or destructs the power semiconductor component used in the oscillator circuit; ignition may occasionally also be completely prevented.

According to the present invention, by using a suitable, compact free-running oscillator circuit it may be ensured in each operating state in a simple manner that a sufficient portion of the available HF power is coupled into the resonator. The use of novel high refractory semiconductor technologies, e.g. SiC or GaN, is particularly advantageous in constructing the oscillator according to the present invention in direct proximity of the engine, since these technologies are characterized by good frequency response $f_T$ even at high temperatures, e.g. >200° C., due to the high power density and high integration density.

DRAWING

Exemplary embodiments of the present invention are explained on the basis of the drawing.

Figure 2:
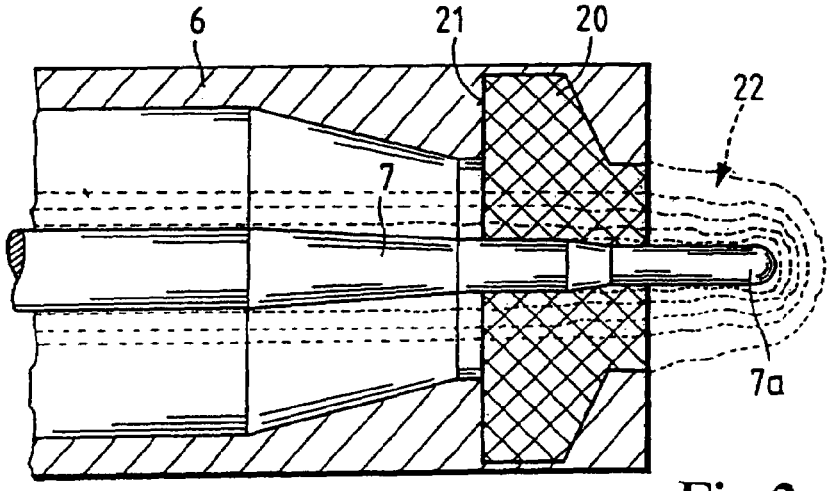
Figure 3:
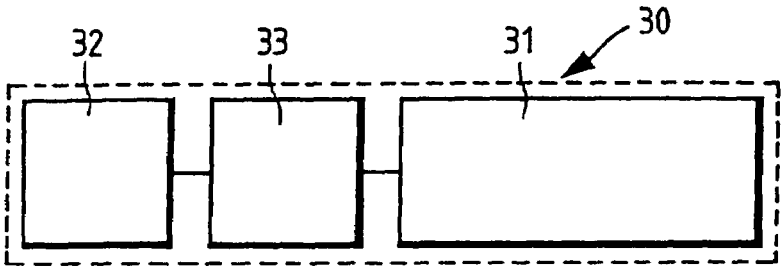

FIG. 1 shows a schematic view of a device for high-frequency ignition of an air-fuel mixture in an internal combustion engine having a coaxial waveguide structure as resonator;

FIG. 2 shows a design according to the present invention of the end of the resonator protruding into the combustion chamber of the internal combustion engine and a view of the field lines of the end of the resonator protruding into the combustion chamber of the internal combustion engine; and FIG. 3 shows a block diagram of an ignition unit having a free-running oscillator, a resonator, and incoupling of the high-frequency oscillations into the resonator.

DESCRIPTION OF THE EXEMPLARY EMBODIMENTS

FIG. 1 shows a schematic view of a device for high-frequency ignition of an air-fuel mixture in an internal combustion engine having elements of what is known as a high-frequency spark plug 1. In detail, an HF generator 2 and a possibly optional amplifier 3 are present which, as a microwave source, generate the high-frequency oscillations. Inductive incoupling 4 of the high-frequency oscillations into a coaxial waveguide structure constructed as $\lambda_{eff}/4$ resonator 5 is schematically shown as an essential element of high-frequency spark plug 1.

Coaxial resonator 5 is made up of an outer conductor 6 and an inner conductor 7, one so-called open or hot end 8 of resonator 5 together with inner conductor 7 causing the ignition, in this case as igniter 7*a* insulated from outer conductor 6. The other cold end 9 of resonator 5, distanced from the combustion chamber, represents a short circuit for the high-frequency oscillations. Dielectric 10 between outer waveguide 6 and an inner conductor 7 is essentially composed of air or of a suitable non-conductive material. A seal 11 is present solely for sealing open end 8 of resonator 5 from the combustion chamber. Seal 11 is made of a non-conductive material, ceramic for example, which withstands the temperatures in the combustion chamber. The dielectric properties of filling material 10 and/or seal 11 determine the dimensions of resonator 5.

The principle of field superelevation in a coaxial resonator 5 having the length $(2n+1)*\lambda_{eff}/4$ with $n \geqq 0$ is used in this high-frequency spark plug 1. The high-frequency signal, which is generated by a sufficiently powerful microwave source as generator 2 and possibly amplifier 3, is fed into resonator 5 via incoupling 4, e.g., inductively, capacitively, a mixture of both, or via an aperture coupling. Due to the formation of a voltage node at short circuit 9 and a voltage antinode at an open end 8, a field resonance appears at igniter 7*a*, resulting in the free-standing plasma mentioned in the preamble of the description.

The essential elements of the present invention may be learned from FIG. 2. For compensating the effects of field distortion or field weakening at the tip of inner conductor 7 or igniter 7*a* caused by seal 11 of open end 8 according to FIG. 1, the cross section of a seal 20 according to FIG. 2 is varied in the area of open end 8 of resonator 5. This takes place, for example, via abrupt cross-section changes 21, or also via smooth changes, tapering, or the like. For example, the cross section of the inner contour of outer conductor 6 and the cross section of the outer contour of inner conductor 7, 7*a* may be appropriately varied in predefined areas.

The detailed geometric dimensions of the one end 8 of resonator 5 are determined as a function of the system parameters and the material parameters of the entire device. Field lines 22 are additionally indicated in FIG. 2 for the purpose of showing how an optimal geometric design of seal 20 results in a field line distribution which optimally makes a free-standing plasma possible according to the present invention.

FIG. 3 shows essential elements of a high-frequency ignition unit 30 in a block diagram. In detail, this includes an HF ignition unit 31 as was described on the basis of FIGS. 1 and 2. Furthermore, a frequency-determining, free-running oscillator 32 using power transistors based upon refractory HF semiconductor technologies, e.g., refractory SiC or GaN components, and incoupling 33 for the HF oscillations of oscillator 32 into ignition unit 31 are present. Operation-related fluctuations in the frequency may be taken into account by using a suitable construction of oscillator 32, which is essentially known.

What is claimed is:

1. A device for igniting an air-fuel mixture in an internal combustion engine using a high-frequency electrical power source, comprising:

a coaxial waveguide structure into which the high-frequency electrical power source is coupled, the coaxial waveguide structure having an inner conductor and outer conductor;

wherein the inner conductor projects from one end of the coaxial waveguide structure by a predefined amount and protrudes into an individual combustion chamber of a cylinder of the internal combustion engine, a microwave plasma being generated at the one end of the coaxial waveguide structure by a high voltage potential, and wherein the one end of the coaxial waveguide structure is configured as an igniter such that when a voltage potential is applied, a free-standing plasma is generated in the air-fuel mixture around the inner conductor of the coaxial waveguide structure that projects from the one end of the coaxial waveguide structure, by field lines protruding into the combustion chamber;

wherein the coaxial waveguide structure is configured such that, for a predefined effective wavelength of a high-frequency oscillation that is coupled in, a cavity resonator results at least to (predefined effective wavelength)/4;

wherein the one end of the coaxial waveguide structure having the inner conductor protruding into the combustion chamber includes a seal made of dielectric material between the outer conductor and the inner conductor, the seal having at least one of an abrupt change and a smooth change in radial diameter along the axial direction, whereby an optimal configuration of the field lines is provided for generating the free-standing plasma.

2. The device of claim 1, wherein the coaxial waveguide structure is configured such that, for a predefined effective wavelength of a high-frequency oscillation that is coupled in, the cavity resonator results approximately according to the formula (2n+1)*(predefined effective wavelength)/4, wherein $n \geqq 0$, and wherein the high-frequency oscillation is coupled in by one of a capacitive coupling, inductive coupling, mixed coupling, and aperture coupling.

3. The device of claim 1, wherein the seal is mounted in a recess of the outer conductor, the recess having at least an abrupt enlargement in radial diameter.

4. The device of claim 1, wherein in an area of the one end of the waveguide structure having the inner conductor protruding into the combustion chamber, a cross section of the inner contour of the outer conductor and a cross section of the outer contour of the inner conductor are correspondingly changed at least one of abruptly and smoothly.

5. The device of claim 1, wherein an electrical signal that is a function of physical variables of the free-standing plasma in the air-fuel mixture is decoupled at one of the high-frequency electrical power source and the coaxial waveguide.

6. The device of claim 5, further comprising: an analyzing circuit for further processing the decoupled electrical signal, whereby at least one of a device diagnosis, a regulation of the high-frequency electrical power source, and a control of predefined operating functions is effected.

7. The device of claim 1, wherein the high-frequency electrical power source includes a free-running oscillator circuit, and wherein a combination of the free-running oscillator circuit, the coaxial waveguide and a further component in a common housing forms a compact ignition unit.

8. The device of claim 7, further comprising an amplifying circuit connected to the free-running oscillator circuit downstream of the free-running oscillator circuit.

9. The device of claim 8, wherein at least one of the free-running oscillator circuit and the amplifying circuit is an integrated semiconductor circuit including one of SiC and GaN components.

* * * * *